United States Patent [19]

Fegley

[11] 3,967,757

[45] *July 6, 1976

[54] ANTI-BURGLARY IRRITANT SPRAYING DEVICE

[76] Inventor: Charles Robert Fegley, 1606 Frush Valley Road, Laureldale, Pa. 19605

[ * ] Notice: The portion of the term of this patent subsequent to Apr. 23, 1991, has been disclaimed.

[22] Filed: Feb. 3, 1975

[21] Appl. No.: 546,667

Related U.S. Application Data

[63] Continuation-in-part of Ser. No. 349,300, April 9, 1973, abandoned.

[52] U.S. Cl. ..... 222/5; 222/83.5; 222/162; 222/61

[51] Int. Cl.[2] ..... B67B 7/24

[58] Field of Search ..... 222/173, 182, 153, 402.13, 222/402.14, 477, 504, 402.1, 402.11, 183, 61, 3, 5, 180, 160, 162, 325, 326, 83, 83.5; 251/348, 354; 116/112, 106, 81, 124; 9/316, 319, 320

[56] References Cited

UNITED STATES PATENTS

| | | | |
|---|---|---|---|
| 1,786,273 | 12/1930 | Turner | 116/81 |
| 2,534,465 | 12/1950 | Marini | 222/162 |
| 2,665,037 | 1/1954 | Zublin | 222/162 |
| 3,137,414 | 6/1964 | Steinkamp | 222/402.13 |
| 3,180,524 | 4/1965 | Shepard et al. | 222/5 |
| 3,198,384 | 8/1965 | Anderson | 222/76 |
| 3,203,594 | 8/1965 | Jones | 222/76 |
| 3,228,565 | 1/1966 | Stanzel | 222/325 |
| 3,266,668 | 8/1966 | Davis | 222/5 |
| 3,377,005 | 4/1968 | Marder | 222/402.13 |
| 3,426,942 | 2/1969 | McMains et al. | 222/5 |

FOREIGN PATENTS OR APPLICATIONS

| | | | |
|---|---|---|---|
| 555,233 | 1/1957 | Italy | 9/316 |

*Primary Examiner*—Robert B. Reeves
*Assistant Examiner*—H. Grant Skaggs

[57] ABSTRACT

A chemical dispensing anti-burglary device is described in which a chemical irritant such as tear gas is discharged into the area to be protected when an intruder opens a window or opens a door or enters an unauthorized area with which the device is associated. The anti-burglary device employs a spring biased pressurized container for discharging a chemical through a passageway and nozzle. A mechanical trigger for releasably retaining the pressurized container in a cocked position, an improved mechanical and electromechanical trigger to release the chemical, and a built in safety to deactivate the device which makes it virtually impossible to accidentally discharge the device are described.

12 Claims, 30 Drawing Figures

ANTI-BURGLARY IRRITANT SPRAYING DEVICE

This is a continuation-in-part of application Ser. No. 349,300 filed Apr. 9, 1973 and now abandoned.

BACKGROUND OF THE INVENTION

The invention relates generally to an anti-burglary device and more particularly to an anti-burglary device which discharges a chemical irritant such as tear gas from a pressurized container, one type of which is an aerosol container, into a protected area upon activation by an unauthorized person, causing the protected area to be flooded with a chemical irritant and forcing evacuation of the protected area by the intruder; but the invention is not limited to the use of the aerosol type container.

Chemical weapons have been known in the art for many years. One type of chemical weapon is the conventional tear gas grenade in which the firing member is generally triggered manually and said grenade is manually hurled at a target area, causing the target area to be flooded with the chemical irritant.

In another type of chemical weapon, the chemical irritant is stored under pressure in an aerosol type container. The firing member is again generally triggered manually and the chemical irritant in the form of a spray is manually directed at a target.

A third type of chemical anti-burglary device discharges an explosive tear gas shell into the area but this type is both dangerous and very limited as to the amount of tear gas which is discharged into the area to be protected.

Thus what is needed in an anti-burglary device in the form of a chemical dispenser which can be discharged by relatively small amount of mechanical force or which can be triggered by an electrical signal from remote contacts or other type sensors, even though the chemical weapon employs a relatively heavy spring for actuating the discharging means with sufficient force to release the chemical from the pressurized container but is positively secured against accidental release until triggered by an intruder and which will then release a sufficient volume of chemical into the protected area to force evacuation by the intruder.

SUMMARY OF THE INVENTION

The principle object of the present invention is to provide an anti-burglary device of the chemical dispensing type which may be triggered either directly by a small amount of mechanical force or remotely from electrical sensors and a power source or by both electrical and mechanical means and yet is positively secured against accidental release.

A further object of the invention is to provide an anti-burglaary device of the chemical weapon type which is readily triggered by a cord connecting the device to a window, door or object which might be moved by an intruder, or by an intruder entering an unauthorized area.

Another object of the invention is to provide an improved means of discharging the chemical into the protected area in a minimum amount of time in order to force the intruder from the protected area and to prevent the intruder from re-entering the protected area for a reasonable amount of time.

A further object of the invention is to provide an anti-burglary device which can easly be activated yet when deactivated is virtually impossible for a small child to activate or virtually impossible to accidentally discharge.

A further object of the invention is to provide an anti-burglary device having means for reloading the device and resetting the weapon in its cocked position after the device has been triggered.

Another object of the present invention is to provide a directable emission of the chemical, such as by means of rotatably adjustable dispersing head, so that the invention might be located in a concealed place yet direct the chemical into the protected area.

According to the principle aspect of the present invention there is provided an improved means for releasably retaining a spring biased pressurized chemical container slidably mounted in a cavity containing a discharging means and passageway leading to a rotatably adjustable dispensing head with nozzle. A cord, cable, wire or the like connects the trigger element to a window, door or other object which might be moved by an unauthorized person entering a room or building, or across a walkway or other area from which it is desired to restrict unauthorized persons. The trigger element retains the slideably mounted spirng biased pressurized chemical container in shouldered engagement, thereby retaining the pressurized chemical container in its cocked position and requiring positive force for release. When the door or window associated with the device is opened by an unauthorized person or when the person enters the restricted area, the cord connected to the trigger element moves the latter from shouldered engagement, thereby releasing the slideably mounted pressurized chemical container and permitting the container to be thrust toward the passageway by the force of the spring associated with the said container and causing the said container to discharge the chemical through the passageway and rotatable dispensing head into the protected area.

Since the trigger element, which serves to retain the pressurized chemical container in its cocked position is slideably mounted; a relatively small amount of force is required to move the trigger element from shouldered engagement with the said container and discharge the container, even though a relatively strong spring is employed for activating the discharging means. As a consequence, the cord connected to the trigger element will not break in triggering the chemical weapon. The resistance to movement of the cord due to its connection to the trigger element is sufficiently low so as not to be observed by an intruder. Nevertheless, the trigger element serves to retain the container safely in its cocked position against accidental release.

Since the trigger element is slideably supported in a narrow slot and provided with a narrow opening to insert a cord with a narrow specially haped loop on it; it is virtually impossible for a small child to activate the device when the cord is removed. In addition, a safety pin is provided as an additional safegaurd against accidental discharge.

Alternatively, an electromechanical actuator may be used in releasable engagement with a self-camming trigger element such that the electromechanical actuator latch lever retains the trigger element which is shaped such as to be self-camming from the pressure exerted on the trigger element by the spring biased pressurized chemical container. When a contact or other electrical sensing element is operated by an unauthorized person entering a protected area, the solenoid is energized, operation the solenoid latch lever, freeing the self-caming trigger element which causes the spring biased container to activate the discharging means, discharging the chemical through the passageway and rotatable dispensing head into the protected area.

The self-camming trigger element is shaped so as to exert only a small amount of force on the solenoid latch lever and a relatively small low power solenoid may be used to allow operation from batteries in locations remote from ordinary power lines. The solenoid latch lever nevertheless can retain the trigger element safely against accidental release from mechanical or electrical transient shock.

An additional method of retaining the trigger element is to replace the solenoid latch with a fusable link such that the trigger element is held in position until a voltage is passed through the fusable link, thus releasing the container and discharging the irritant.

The anti-burglary device of the chemical weapon type of the present invention may be utilized in homes, factories, farms office buildings by connecting the cord attached to the trigger element of the device to doors, windows, machinery, appliances, etc., and may be used in connection with vehicles such as boats, trucks, airplanes, etc. The device may also be employed for any other application wherein it is desired to prevent unauthorized persons from moving certain objects. The device may further be utilized to prevent unauthorized persons from entering restricted areas by extending the cord connected to the trigger element a short distance above the ground across a walkway, entrance way, etc., into the area so that the intruder will strike the cord and thereby activate the mechanism and discharge the chemical irritant.

Alternatively any of the foregoing embodiments of the present invention may be accomplished by means of electrical contacts or other sensors similarly positioned and operated from ordinary power lines or from batteries internal or external from the items or area to be protected.

Once actuated, the spray cannot be turned off by the intruder and the entire amount of pressurized chemical irritant will be discharged into the protected area making it impossible for the intruder to remain in the protected area without having protective equipment.

Other objects, aspects and advantages of the invention will become apparent from the following description taken in connection with the accompanying drawings.

DESCRIPTION OF THE PREFERRED EMBODIMENTS

Figure 1:
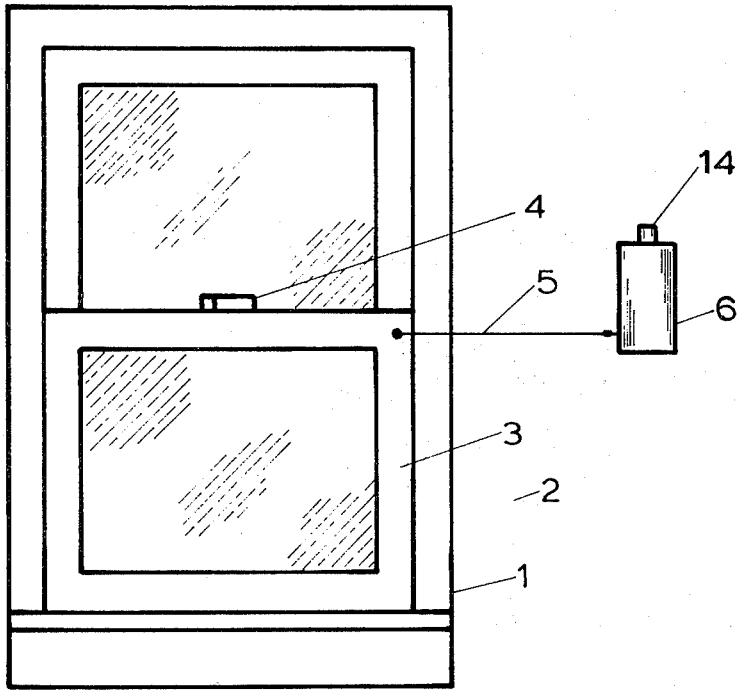
FIG. 1 is an elevational view of a wall of a room having one embodiment of the chemical dispensing anti-burglar device of the present invention secured to the wall and connected by means of a cord to the sash of a window in the wall.
Figure 2:
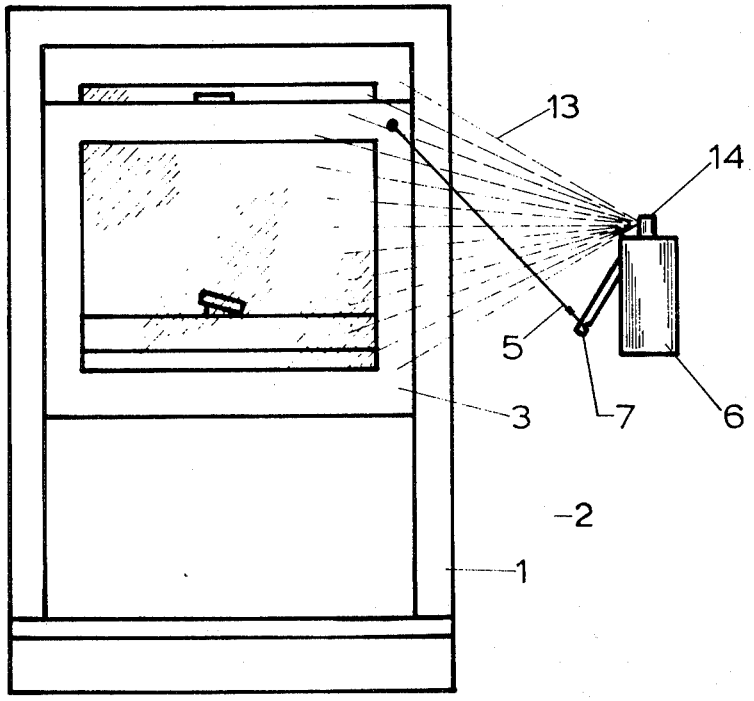
FIG. 2 is an elevational similar to FIG. 1, but showing the window open and showing the device discharging.
Figure 3:
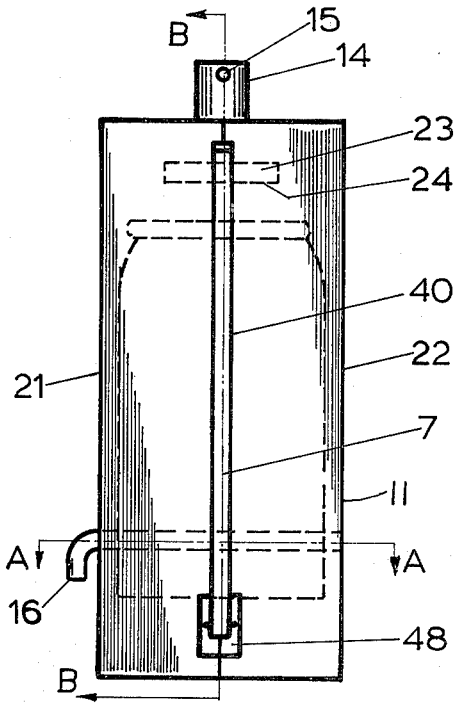
FIG. 3 is a front elevational view of the chemical dispensing anti-burglar device.

Referring now to the drawings in detail, wherein like reference characters designate like parts throughout the various views, there is shown in FIGS. 1–6, one form of the chemical dispensing anti-burglar device, called device hereafter, of the chemical weapon type according to the present invention, generally designated 6. The device 6 is secured to a wall 2 and connected by means of a cord 5 to a window sash 3 in the wall 2 so that upon opening of the window sash 3 by a burglar or intruder, the device 6 will be actuated to discharge a chemical 13 such as tear gas into the restricted area. The device 6 whose front is shown in FIG. 3 comprises of a pressurized chemical container 31, called pressurized container hereafter, mounted in a body member 11 comprising of a left body half 21 and a right body half 22. The body halves 21 and 22 when assembled provide three flat sides, other than the front, for mounting the device 6 to the wall 2 adjacent to the window frame 1 or elsewhere, as may be convenient, and the cord 5 connected from the device 6 to a wide variety of objects in many ways.

Figure 6:
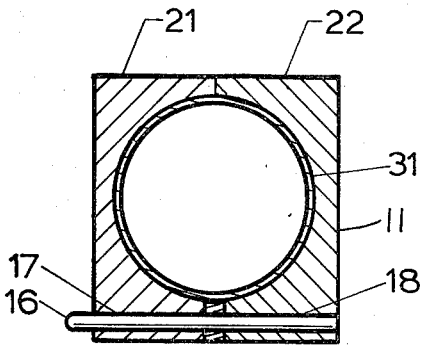
FIG. 6 is a partial horizontal section taken along line A—A of FIG. 3 with the trigger element cocked and locked by the safety pin.
Figure 5:
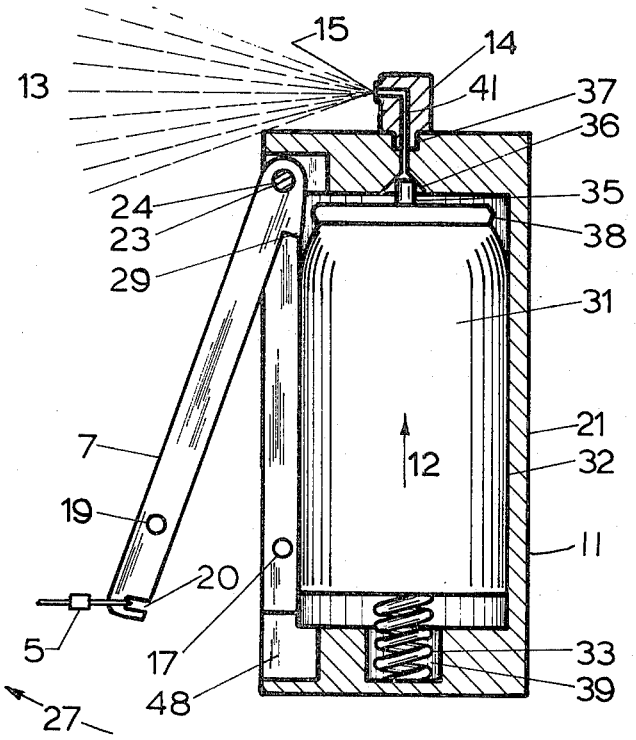
FIG. 5 is a vertical section taken along line B—B of FIG. 3 similar to FIG. 4 but showing the container in its release position after the device has been triggered.
Figure 4:
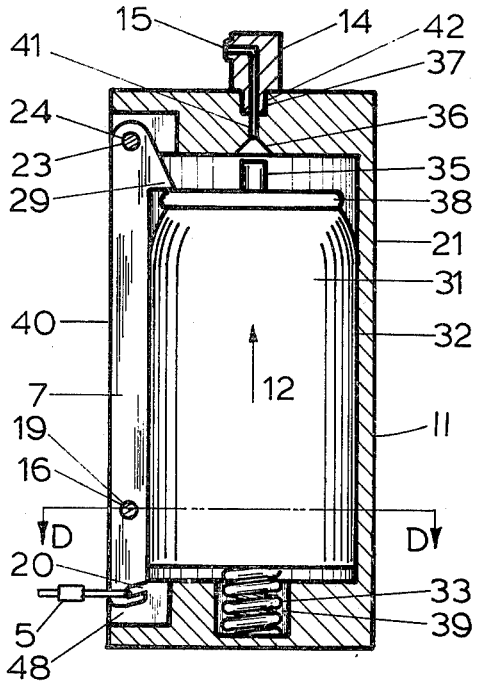
FIG. 4 is a vertical section taken along line B—B of FIG. 3 showing the pressurized container in its cocked position displaced from the open entry section of fluid passageway.

The coaxial cylindrical bores 32 and 39, as shown in FIGS. 4 and 5, are formed when the symetrically opposite body halves 21 and 22 are joined together as shown in FIGS. 3 and 6. The cylindrical bore generally designated 32 slideably mounts the pressurized container 31. The pressurized container 31 of which one type is sold by Defense Products Manufacturing Corporation, 1628 South Hanley Rd. St. Louis, Mo. identified as their "Paralyzer" and another type is sold by Penquin Industries, Inc., Parkesburg, Pa. identified as their "10-4 Chemical Billy" but the invention is not limited to the use of these containers. The pressurized container 31 comprises of a spring urged projecting dispensing spout 35 which when depressed discharges a chemical 13 through the center of the projecting dispensing spout 35.

The cylindrical bore generally designated 39 is coaxial with cylindrical bore 32 and provides a means for confining the spring 33. Spring 33 is mounted to urge the pressurized container 31 in the direction 12.

Now referring to FIGS. 4 and 5; the body member 11 comprising of the body halves 21 and 22 forms a fluid passageway 41 having an entry section 36 for engaging with the projecting dispensing spout 35 of container 31 on one end and a coaxial hole 42 for mounting a rotatable dispensing head 14 on the other end. The fluid passageway 41 and the dispensing head 14 provide a means for the chemical 13 to be discharged into and directed from when the projecting dispensing spout 35 of the container 31 is forced into the entry section 36 by the spring 33 acting to move the slideably mounted container 31 in the direction of arrow 12. The funnel shape of the entry section 36 engages the projecting dispensing spout 35, which is made of a relatively soft material and therefore provides an adequate seal at the entry section 36 to retain fluid flow in the passageway 41 at pressures normally used in the pressurized container 31.

The container 31 in the position illustrated in FIG. 4 is in its cocked position where the spring 33 is compressed and the spout 35 is coaxial but not seated into the entry section 36. The container 31 is releasably restrained in a cocked position by a trigger element 7. The trigger element 7 is generally a flat member and includes a shaped latch portion 29, holes 24 and 19 and a notch 20 and is best seen in FIGS. 4 and 5. The trigger element 7 is rotatably mounted on a pivot pin 23 and is slideably contained in slot 40 formed by the body halves 21 and 22. The shaped latch portion 29 engages the rim 38 of the container 31 when in the cocked position as shown in FIG. 4. The spring 33 urged container 31 causes trigger element 7 to rotate counterclockwise as shown in FIG. 4 around pivot pin 23 and therefore will be held against the interior surface of slot 40 formed by body halves 21 and 22, thus retaining the container 31 in its cocked position.

The container 31 may be locked in its cocked position and the trigger element 7 in its set position as shown in FIG. 4 by means of a safety pin 16 which passes through hole 17 in body half 21, next through hole 19 in trigger element 7 and hence through hole 18 in body half 22. Holes 17, 18, 19 are coaxial on assembly and cocking of trigger element 7 and are perpendicular to the plane of travel of the trigger element 7 such that when safety pin 16 is inserted through holes 17, 18 and 19 the trigger element 7 is restrained from moving, thereby, safely retaining the container 31 in its cocked position.

A notch, 20, is provided near the end of the trigger element 7. The looped cord 5 is connected at one end to the window sash 3 and at its other end to the trigger element 7 by being looped over trigger element 7 to engage notch 20. When it is desired to place the device in condition for firing upon opening of the window sash 3; the safety pin 16 is removed from holes 17, 18 and 19. If the window sash is opened by a burglar or other intruder, the cord 5 will be pulled in such a manner as to rotate the trigger element 7 moving the shaped latch portion 29 out of engagement from the rim 38 of the container 31 permitting said container 31 to be thrust in direction 12 and seating the container spout 35 into entry section 36. In such position, as shown in FIG. 5, the pressure from spring 33 acting on the container 31 causes the pressurized chemical irritant 13 to be discharged through the passageway 41 and dispensing head 14 into the protected area as shown in FIG. 2.

After the device has been fired in the manner described herein above, the body halves can be separated to replace the container 31, after restoring trigger element 7 to its cocked position as depicted in FIG. 4.

It is an important feature that the trigger element 7 be rotatable and that the shaped latch portion 29 thereof present a surface which will slide smoothly on the rim 38 of the container 31 when the trigger element 7 is pulled. As a consequence the trigger element 7 may be easily withdrawn from engagement without substantial force. Yet when the trigger element 7 is positioned in engagement with the rim 38 of the container 31, the trigger element 7 serves to positively retain container 31 in its cocked position. Hence substantially less force is required to trigger device 6 of the present invention than would be required if the container 31 were retained in its cocked position by means of a transversely extending trigger pin or the like, yet the container 31 is still safely retained in its locked position against accidental release by safety pin 16 passing through holes 17, 18 and 19.

Yet another important feature is that the dispensing head 14 is rotatable in socket hole 37 through a large angle up to 360 degrees so that the chemical irritant spray 13 may be directed into any area relative to the triggering object such as when it is desired to spray into the area after an unauthorized person moves a triggering object or entryway at a corner of the area to be protected.

Another important feature is that the spring 33 be of substantial force so that the projecting dispensing spout 35 will seat in the entry section 36 with sufficient force to release the pressurized chemical irritant through the passageway 41 and out the dispensing head 14.

If it is desired to utilize the chemical irritant anti-burglar device again, it is reset as illustrated in FIG. 1. If it is desired to render it temporarily inoperative, the safety pin 16 is inserted through the passages 17, 18 and 19 to lock the trigger element 7 and thence the container 31 in its cocked position.

Figure 30:
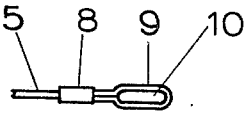
FIG. 30 is a horizontal view showing the shape of the loop for insertion over the trigger element.

Another important feature is that the slot 48 in body halves 21 and 22 for inserting the looped cord 5 be made with a minimum clearance for the looped portion of the cord 5. It is also important to keep the opening 10 of the loop 9 of cord 5, as shown in FIG. 30, just wide enough to slip over the end of trigger element 7. By keeping the loop 9 and the slot 48 in body halves 21 and 22 as narrow as possible; it becomes very difficult; if not impossible, to move the trigger element 7 without a specially shaped loop or hook placed in slot 20 of trigger element 7. This is necessary to keep small children from accidentally triggering the device.

Further security from accidental release is achieved by keeping the trigger element 7 flush with or recessed from the exterior surface of the body halves 21 and 22. By mounting the trigger element 7 in the body halves 21 and 22 in this manner, there is no surface of the trigger element 7 exposed to grip and therefore cannot be released.

It is also important in this embodiment that the discharging means comprises a valved pressurized container 31, having a projecting dispensing spout 35 which when depressed causes fluid discharge therethrough. The body member 11 contains a fluid passageway 41 having a funnel shaped entry section 36 against which the projecting dispensing spout 35 is depressed and forms a seal between the entry section 36 of the passageway 41 and the projecting dispensing spout 35 when the pressurized container 31 is released, thereby causing fluid discharge from pressurized container 31 through the passageway 41.

Figure 7:
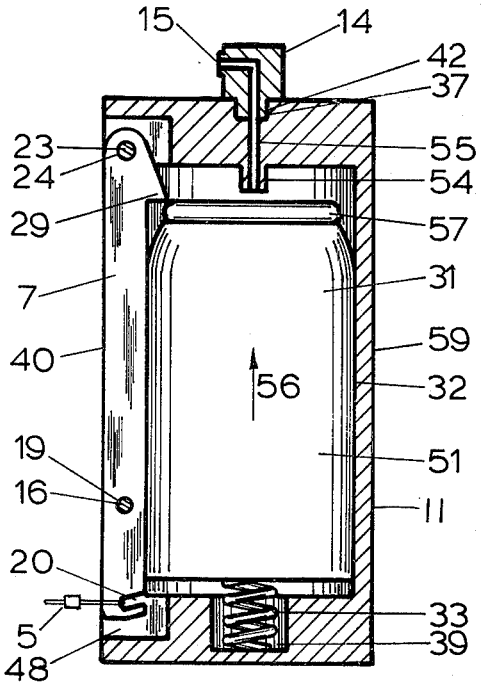
FIG. 7 is a veritcal section similar to FIG. 4 but showing a second embodiment of the anti-burglar device containing a pressurized container of the aerosol type but with a recessed valve.

A second embodiment of the invention is illustrated in FIG. 7. In this embodiment the basic structure is as previously described and like numbers are used to indicate like or corresponding parts.

In this embodiment, the pressurized chemical irritant container 31, shown in FIG. 4 having a projecting dispensing spout 35, is replaced with a pressurized chemical irritant container 51, shown in FIG. 7, having a recessed valve. Pressurized containers of the aerosol type with a recessed dispensing valve are well known in the trade. In addition, the conical shape of the entry section 36 of the fluid passageway 41 of the first embodiment shown in FIG. 4 is replaced with projecting spout 54 depending from body halves 58 and 59, all of which are shown in FIG. 7.

In this embodiment, all elements function as described in the first embodiment with the following difference. The pressurized container 51 is discharged by the action of the coil spring 33 moving the pressurized container 51 such that the recessed valve of the pressurized container 51 is depressed through engagement with projecting spout 54 and thereby effects discharge.

The chemical irritant 13 is then discharged through the valve of the pressurized container 51, through the entry section 54 and passageway 55 and out the dispensing head 14, then into the area to be protected.

As shown in FIG. 7, when the cord 5 is pulled and the safety pin 16 removed, the trigger element 7 is rotated. This causes the shaped latch portion 29 to be moved from container rim 57 and permits the container 51 to be moved in direction 56, causing discharge through the action of the projecting dispensing spout 54 acting on the recessed valve of container 51. The fluid will then be forced up through passageway 55 and dispersed through orifice 15.

It is important in this embodiment that the discharging means comprises a valved pressurized container 31 having a recessed valve which when depressed causes discharge therethrough. The body member 11 contains a fluid passageway 55 having a projecting spout 54 depending from the body member 11 for engaging and activating the recessed valve of the pressurized container 31 when the pressurized container 31 is released thereby causing discharge.

Figure 8:
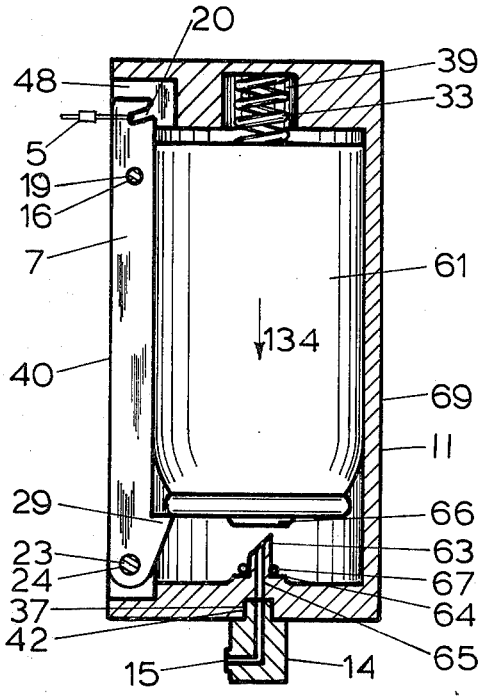
FIG. 8 is a vertical section similar to FIG. 4 but showing a third embodiment of the anti-burglar device containing a pressurized container of the type with a pierceable seal and a means for piercing the seal.

A third embodiment of the invention is illustrated in FIG. 8. In this embodiment the structure is as previously described in the first embodiment and like numbers are used to indicate like or corresponding parts.

In this embodiment, the pressurized chemical irritant container 31, shown in FIG. 4 of the first embodiment and having a projecting dispensing spout 35, is replaced with a pressurized chemical irritant container 61 shown in FIG. 8, having a piercable seal 66. Pressurized containers having piercable seals are well known in the trade. In addition, the funnel shaped entry section 36 of the body halves 21 and 22 of the first embodiment shown in FIG. 4 are replaced with body halves 68 and 69 having a projecting section 63 shaped to pierce seal 66 and a means of making a fluid seal capable of withstanding the pressure required for effectively discharging the chemical irritant through the passageway 65 and into the restricted area.

Now referring to FIG. 8, FIG. 8 is an inverted embodiment of FIG. 4 of the first embodiment in which all elements function as described in the first embodiment with the following exceptions. The pressurized cylinder 61, when released by the trigger element 7, is forced by spring 33, into piercable engagement with the piercing projecting section 63. As the piercable seal 66 is pierced by the action of the projection forward section 63 of the body halves 68 and 69, the spring 33 continues to move the container 61, forming a seal by the action of the O-Ring 67 and its retaining seat 64 and the piercable seal 66 of the pressurized container 61. The chemical irritant 13 is then discharged through the pierced seal 66 of the pressurized container 61, through passageway 65, out the orifice 15, and then into the area to be protected. It is important in this embodiment that the discharge means comprises a pressurized container 61 having a pierceable seal 66 which when pierced will permit fluid discharge therethrough. The body member 11 contains a projecting piercing section 63 depending from the body member 11 set in a position to pierce the piercable seal 66 when the pressurized container 61 is moved toward it. It is also important that a seal 67 be made to prevent fluid leakage within the body member 11 after the pierceable seal 66 is pierced and fluid is discharged through passageway 65.

Figure 9:
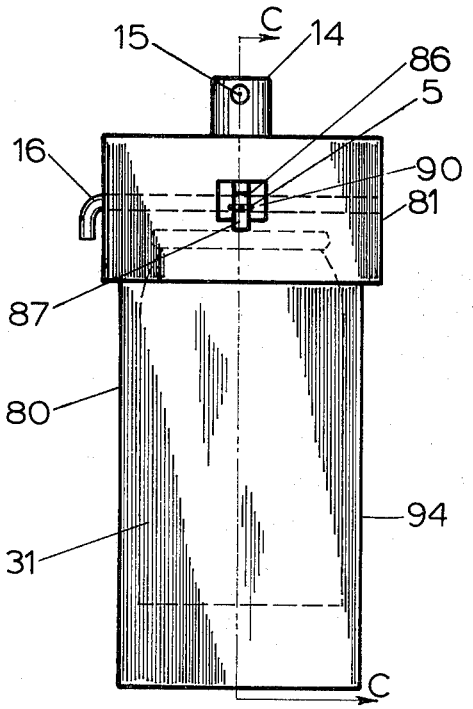
FIG. 9 is a front elevational view of the chemical dispensing device showing an alternate type construction and a slidable trigger.
Figure 10:
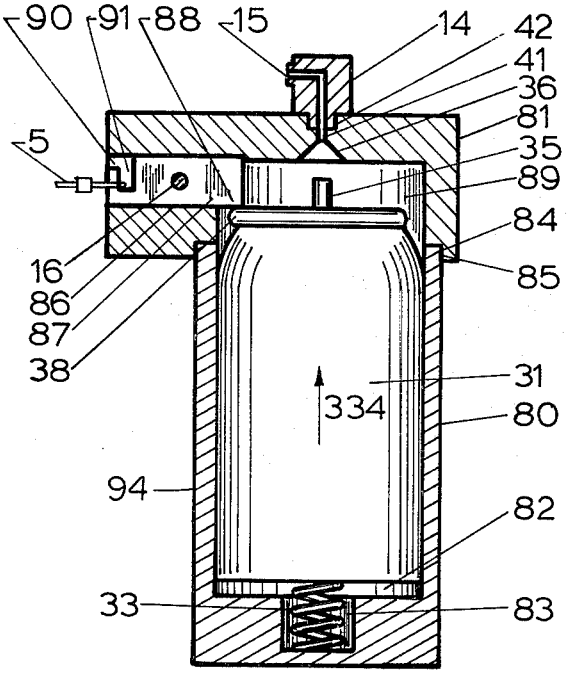
FIG. 10 is a vertical section taken along line C—C of FIG. 9 showing the device in its cocked position.

The preceding embodiments of the invention show the chemical dispensing anti-burglary device in its preferred embodiments containing a rotatable trigger element 7 but it is recognized that the trigger element 7 may be slidably mounted as shown in FIG. 9 and 10. In addition, the body member may be constructed in a different manner as shown in FIGS. 9 and 10.

Therefore, a fourth embodiment of the invention is illustrated in FIG. 9 and 10. In this embodiment, the basic structure is as previously described in the first embodiment and like numbers are used to indicate like or similar parts.

In this embodiment, as shown in FIGS. 9 an 10, the body member 94 is constructed of a lower body section 80 and an upper body section 81. The exterior of lower body section 80 is round in shape while the interior comprises of two coaxial cylindrical bores 82 and 83. The cylindrical bore 82 slideable supports the pressurized contaner 31 and the cylindrical bore 83 serves to mount the spring 33.

The upper body section 81 is rectangular in shape and contains a round bore 84 sized to receive the upper most portion 85 of the lower body section 80 as shown in FIG. 10. Adhesives are used to fasten the two body sections 80 and 81 after assembly.

A slot 86 is formed in the upper body section slideably mount a flat trigger element 87. It is important that the catch 88 on the trigger element 87 slide freely on the flange 38 of pressurized container 31 and also in the slot 86.

A cylindrical bore 89 must also be formed in the upper body section 81 to provide clearance for the pressurized container 31. A fluid passageway 41 and a funnel entry section 36 must also be formed in upper body section 81 which is coaxial with but displaced from the dispensing spout 35 of container 31.

A wide slot 90 is provided where the cord 5 is slipped over the slot 91 in the trigger element 87. It is important that this slot be no wider then required for the clearance of the cord 5 to prevent someone from accidently triggering the device when the cord is removed.

An additional safety is provided by a safety pin 16 which operates in a manner previously described.

When it is desired to activate this device, the cord 5 is connected in slot 91 of trigger element 87 and the safety pin 16 is removed as previously described. An intruder causing the cord 5 to be pulled will slide the trigger element 87 from engagement with the contaner 31. Thus permitting the spring 33 to move the container 31 in a manner to cause the dispensing spout 35 to move into engagement with the entry section 36 of the fluid passageway 41 and cause discharge in a manner previously described, This type of trigger element does not have the mechanical advantage of the rotatable trigger element and requres more force to release the container but can be effectively used for many applications.

Figure 13:
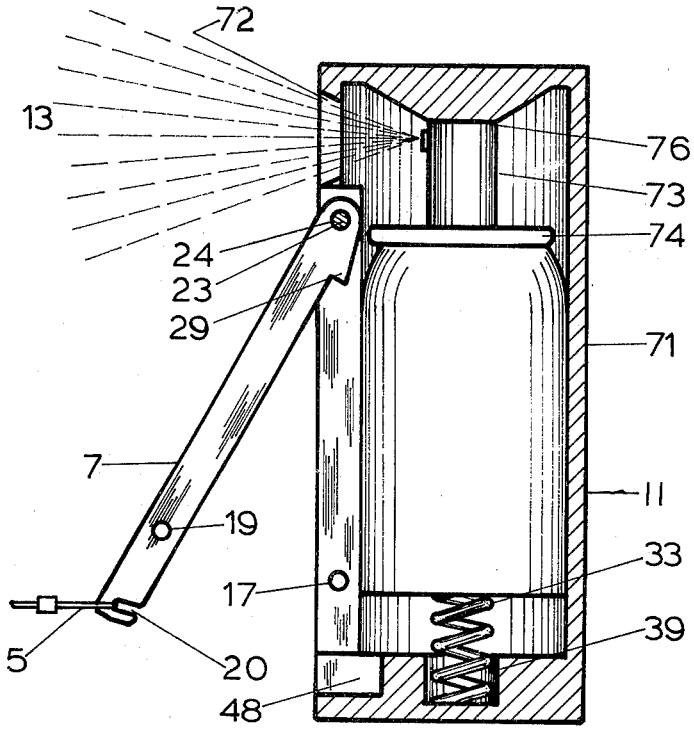
FIG. 13 is a horizontal section taken along line D—D of FIG. 11 but showing the pressurized container in its released position after the device has been triggered.
Figure 11:
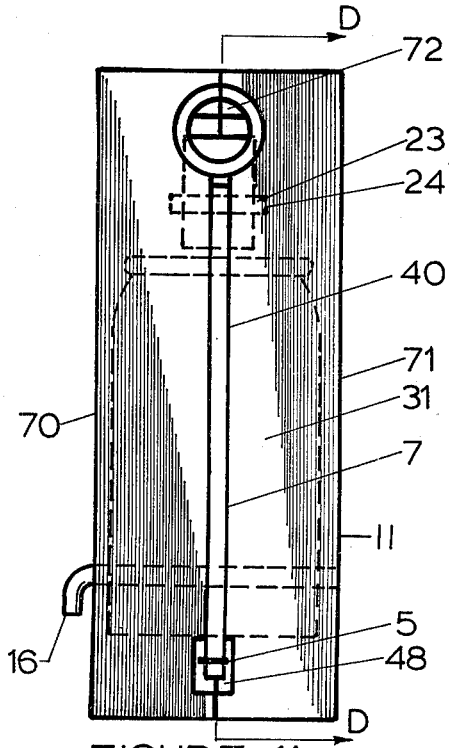
FIG. 11 is a front elevational view similar to FIG. 3 but showing a fifth embodiment of the chemical dispensing anti-burglary device containing a pressurized container of the aerosol type with a projecting cap.
Figure 12:
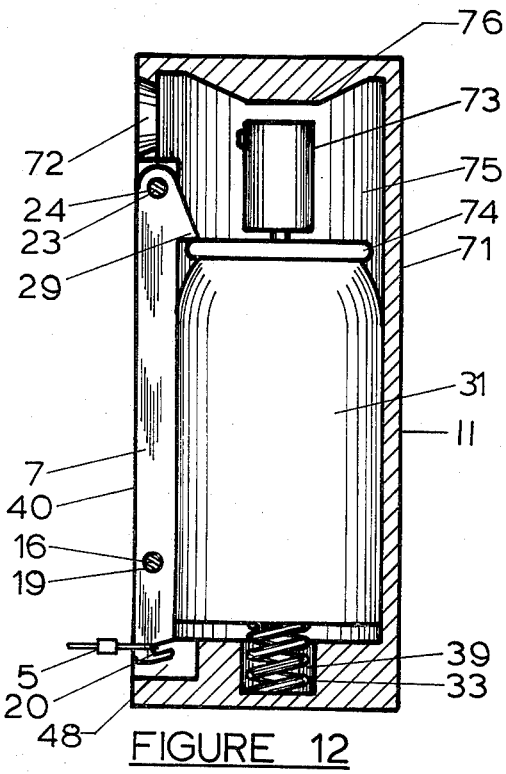
FIG. 12 is a vertical section taken along line D—D of FIG. 11 showing the pressurized container in a cocked position.

A fifth embodiment of the invention is illustrated in FIGS. 11, 12 and 13. In this embodiment, the structure is as previously described in the first embodiment and like numbers are used to indicate like or corresponding parts.

In this embodiment, the projecting dispensing spout 35 of pressurized chemical irritant contaner 31, shown in FIG. 4, is replaced with a projecting dispensing cap 73 shown in FIG. 11, 12 and 13. In addition, the fluid passageway 41 and the entry section 36 are replaced with an aperature 72.

Now referring to FIG. 12 and FIG. 13, the trigger element 7 and the spring 33 operate as before to move the pressurized container 31. In this embodiment, the spring 33 urged pressurized container 31 causes the projecting cap 73 to be depressed against the inside top portion 76 of body halves 70 and 71; thereby causing discharge through aperature 72. It is important in this embodiment that the discharging means comprises a valved pressurized container 31 having a projecting dispensing cap 73 which when depressed causes fluid discharge therethrough. The body member 11 contains an aperture 72 in communication with the projecting dispensing cap 73 to provide for fluid discharge from the body member 11. It is also important that a means be provided in the body member 11 to restrict the movement of the projecting dispensing cap 73 to provide a means to cause fluid discharge upon movement of the pressurized container 31. One means for restricting the movement of the dispensing cap 73 is to provide a surface 76 in body member 11 which will restrict the movement of the dispensing cap 73 when the pressurized container 31 is released. Fluid will be discharged from the pressurized container 31 through the dispensing cap 73 and aperture 72 when the dispensing cap 73 is moved against surface 76 through movement of pressurized container 31.

A sixth embodiment of the invention is illustrated in FIGS. 14–21. In this embodiment the basic structure is previously described in the first embodiment and like numbers are used to indicate like or corresponding parts.

Figure 17:
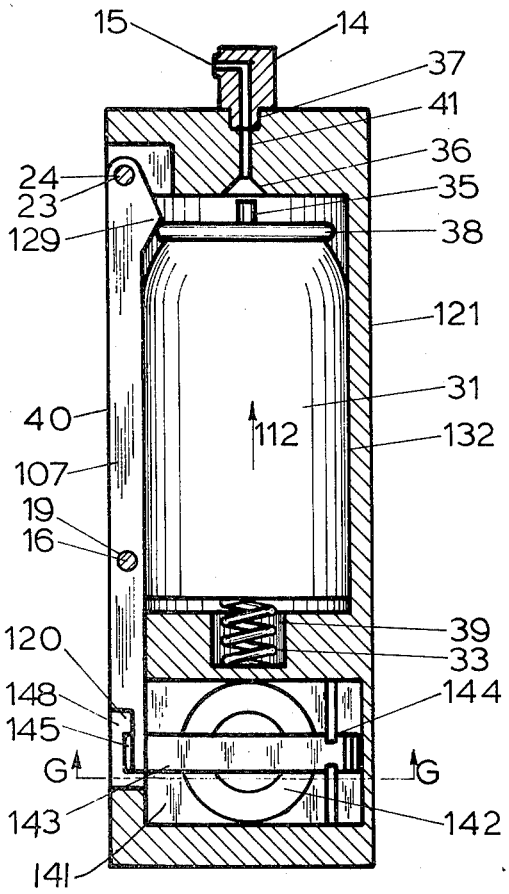
FIG. 17 is a vertical section taken along line E—E of FIG. 16 showing the pressurized container in a cocked position.
Figure 18:
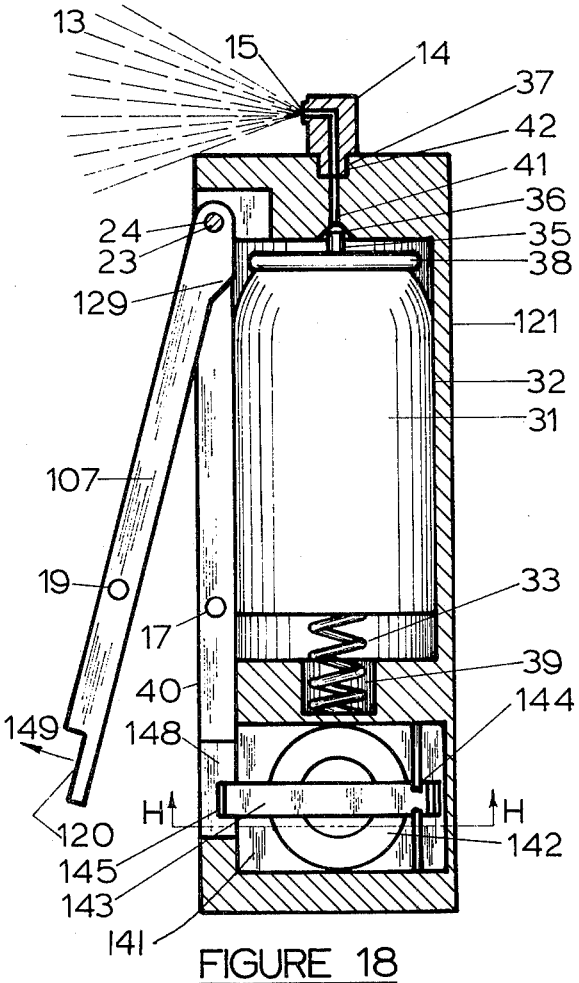
FIG. 18 is a vertical section taken along line E—E of FIG. 16 similar to FIG. 17 but showing the pressurized container in its released position after the device has been triggered.

In the anti-burglar device 6 previously described, the trigger element 7 is released when cord 5 is pulled. The trigger element 7 holds the pressurized container in a cocked position. In this embodiment, the trigger element 7 is replaced by a self-camming trigger element 107 as best seen in FIGS. 17 and 18 wherein a self-camming trigger element 107 will be forced to rotate in the direction of arrow 149 by the action of the flange 38 on the pressurized container 31 of the spring 33 urged pressurized container 31. The operation of this self-camming trigger element 107 will become apparent in the following description.

Figure 14:
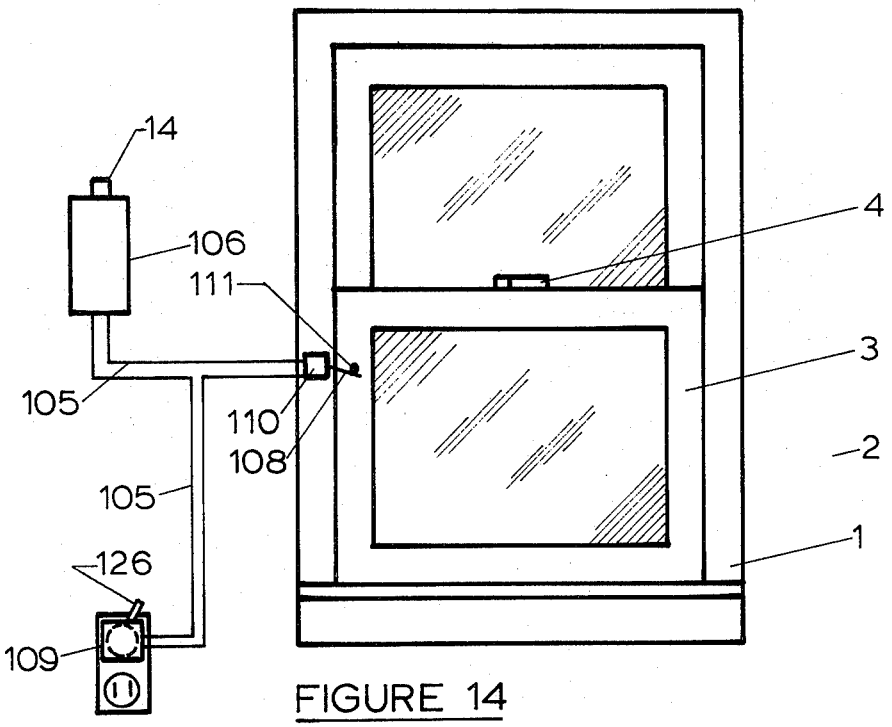
FIG. 14 is an elevational view of a wall of a room having the sixth embodiment of the chemical dispensing anti-burglary device of the present invention secured to a wall and electrically connected to a switch at the window.
Figure 15:
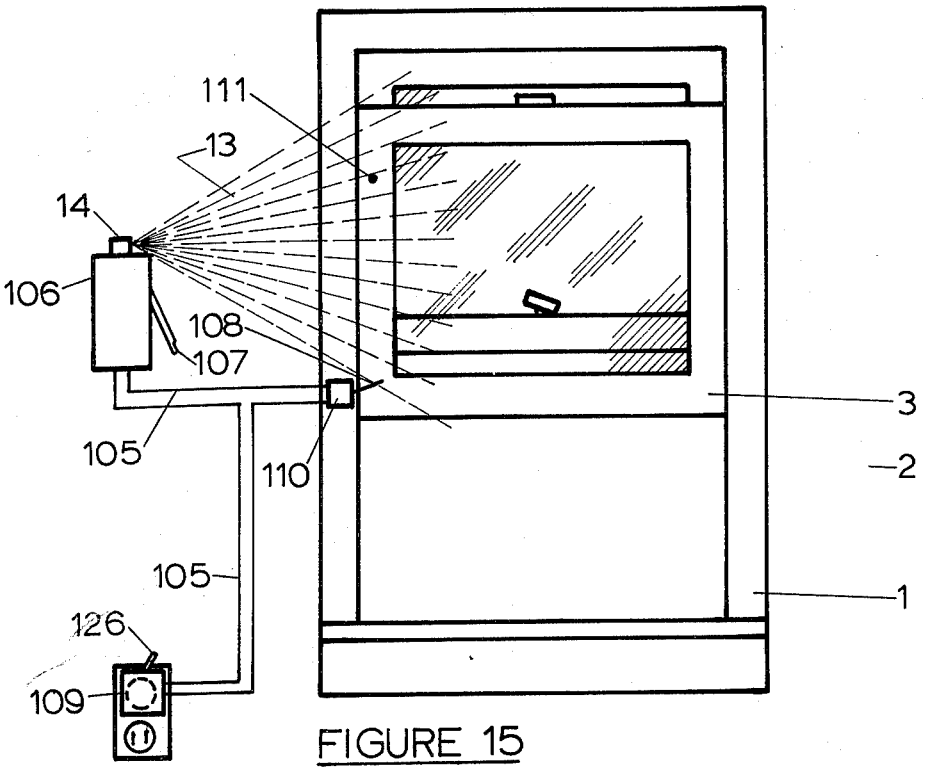
FIG. 15 is an elevational view similar to FIG. 14 but showing the window open and showing the device discharging.

As shown in FIG. 14 and 15, the device 106 can be remotely mounted from a window or other object or entryway to be protected and connected by means of an electrical cable 105 to an electrical switch 110; and on-off switch 126 and a power source 109, so that upon opening the window sash 3 by an unauthorized person, the contacts of switch 110 will close as a result of switch activation pin 111 releasing contact lever 108 of switch 110 electromechanically causing the device 106 to discharge a chemical irritant 13 into the area to be protected. This embodiment of the device comprises of all the components previously described except for the change in the method of triggering previously described and an addition of an electromechanical actuator 141.

Now referring to FIGS. 16–21, an electromechanical actuator 141 is shown. The electromechanical actuator 141 comprises an electromagnetic coil 142, a solenoid latch lever 143, a lever pivot point 144 and a latch lever spring 146. The components of the electromechanical actuator 141 are arranged in a manner that when power is applied to the electromagnetic coil 142, a magnetic flux is generated, causing the latch lever 143 to be attracted toward the coil 142 and to rotate around pivot point 144. THe rotation of the latch lever 143 will be confined from further movement by the electromagnetic coil 142. The latch lever 143 is held in a normal rest position by the action of spring 146 exerting force on the latch lever 143 in direction opposite of arrow 147. This causes the catch 145 of latch lever 143 to move in the same direction and causes the latch lever 143 to rest against the self-camming trigger element 107 and prevent the self-camming trigger element 107 from rotating in the direction 149.

As can be best seen in FIG. 17, the rim 38 of the pressurized container 31 of the spring 33 urged pressurized container 31 engages with the latch portion 129 of the self-camming trigger element 107 causing it to rotate in the direction of arrow 149 about pivot pin 23. The self-camming trigger element 107 is releasably retained from rotating by the catch 145 of the latch lever 143 which is restrained from transverse movement by the pivot point 144.

When switch 110 is closed, electric power is applied to the electromagnetic coil 142, thus, energizing the electromagnetic coil 142. The solenoid latch lever 143 is pulled toward the electromagnetic coil 142 in direction 147 around pivot point 144 thereby moving the latch lever catch 145 away from engagement with the self-camming trigger element 107 at notch 120; whereupon the rim 38 of the pressurized container 31 of the spring 33 urged pressurized container 31 engaging with the latch portion 129 of the self-camming trigger element 107 causes the self-camming trigger element 107 to rotate in the direction of arrow 149. This permits the spring 33 urged pressurized container 31 to be moved in the direction of arrow 112 until the projecting dispensing spout 35 of the pressurized container 31 is in seated engagement with the entry section 36; further movement of the pressurized container 31 will depress the projecting dispensing spout 35 and cause the chemical irritant 13 to be released from the pressurized container 31; through the dispensing spout 35, the entry section 36, the fluid passageway 41 and the orifice 15 in dispensing head 14.

It is an important feature that the self-camming trigger element 107 be rotatable and that the catch 145 of the latch lever 143 slide freely on the notch 120 of the self-camming trigger element 107, hence a consistent release of the latch lever 143 may be obtained on a limited amount of electric power. Yet the self-camming trigger element 107 is positioned in its cocked position in engagement with the latch lever 143, the spring 33 urged pressurized container 31 is securely held in a cocked position safe against accidental release.

Figure 19:
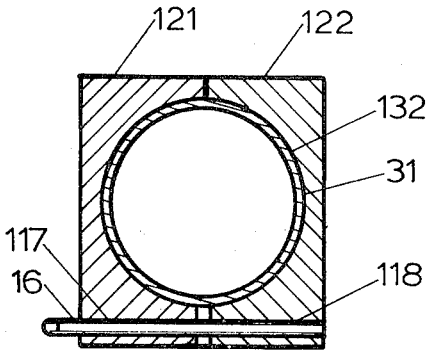
FIG. 19 is a horizontal section taken along line F—F of FIG. 16 with the trigger element cocked and locked by the safety pin.
Figure 16:
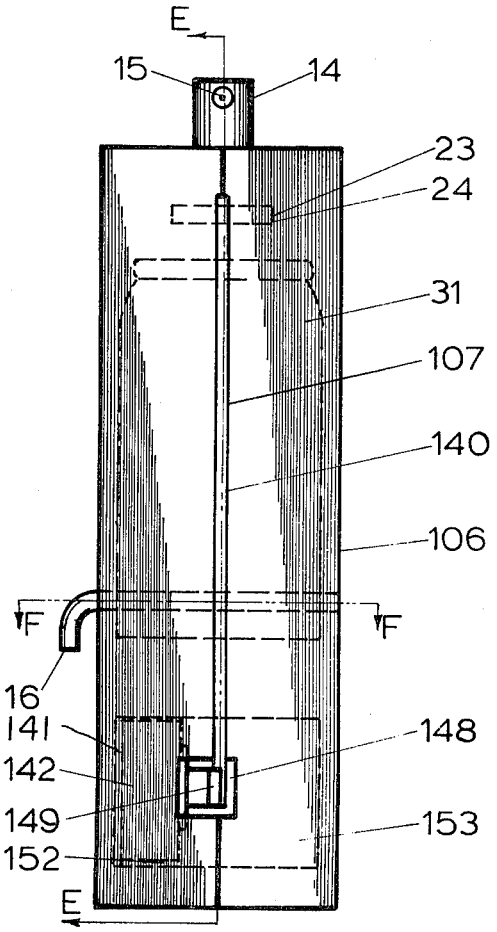
FIG. 16 is a front elevational view similar to FIG. 3 but showing a sixth embodiment of the anti-burglar device containing a pressurized container of the aerosol type with a projecting spout for electromechanical operation.

With the self-camming trigger element 107 in the cocked position shown in FIG. 19, the safety pin 16 may be inserted in holes 117 and 118 to safely lock the self-camming trigger element 107 from accidental discharge.

It is also an important feature that the catch 145 moves in a direction perpendicular to the plane of movement of self-camming trigger element 107 thereby requiring only a small movement of the latch lever 143 permitting the use of a smaller, lower powered electromechanical actuator 141 than would be required of a self-camming trigger element 107 was moved throughout its entire range by electromechanical action or then would be required by an electromechanical actuator acting transversly on the rim 38 of the pressurized container 31.

Figure 22:
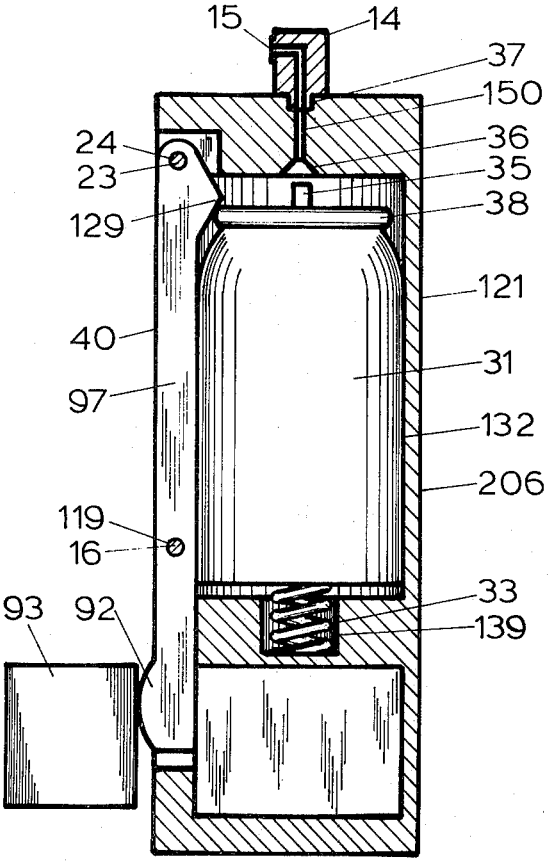
FIG. 22 is a vertical section similar to FIG. 17 wherein the trigger element is held in shouldered engagement with the pressurized container by a movable object thereby retaining the trigger element in its actuation position.
Figure 20:
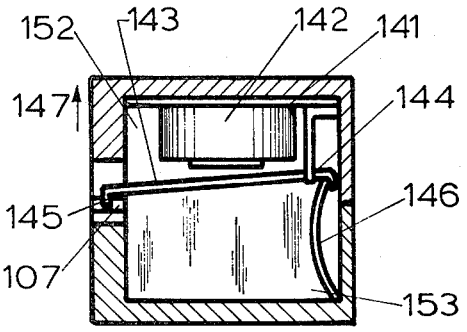
FIG. 20 is a partial horizontal sectional taken along line G—G of FIG. 17 showing the electromechanical actuator of the anti-burglar device wherein the trigger element is electromechanically controlled.
Figure 21:
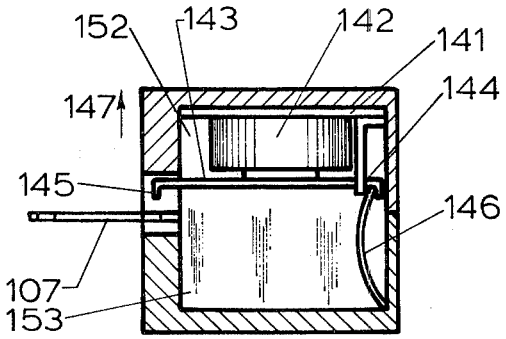
FIG. 21 is a partial horizontal sectional taken along line H—H of FIG. 18 showing the anti-burglary device in its discharging position.

A seventh embodiment of the invention is illustrated in FIG. 22. In this embodiment the basic structure is previously described in the first embodiment and like numbers are used to indicate like or corresponding parts.

In this embodiment, the self-camming trigger element 107 is replaced by a self-camming trigger element 97 wherein the notch 120 is replaced with a projection 92. In addition, the electromechanical actuator 141 has been eliminated and the self-camming trigger element 97 is restrained by a movable object 93. This device 206 is identical to device 106 with the exception of the electromechanical actuator 141 and method of being triggered.

The releasably retaining means acting on the self-camming trigger element 97 is a movable object 93. Any movable object such as a window, door, TV set, Hi Fi set etc. can be mounted to retain the self-camming trigger element 97. If it is desired to move the protected object, the safety pin 16, previously described in inserted in a manner to engage hole 19 in self-camming trigger element 107 thus safely deactivating the device. However, if properly installed, the intruder will not notice the device 206 and move the protected object and cause discharge.

Figure 25:
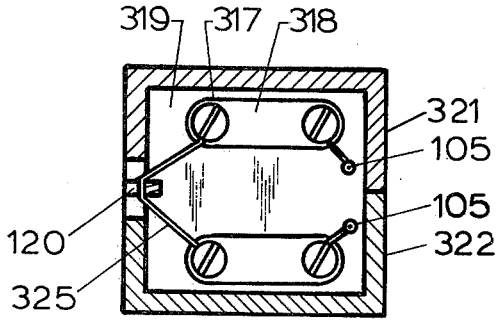
FIG. 25 is a horizontal section taken along line M—M of FIG. 24 showing the fusible link holding the trigger element in its actuation position.
Figure 23:
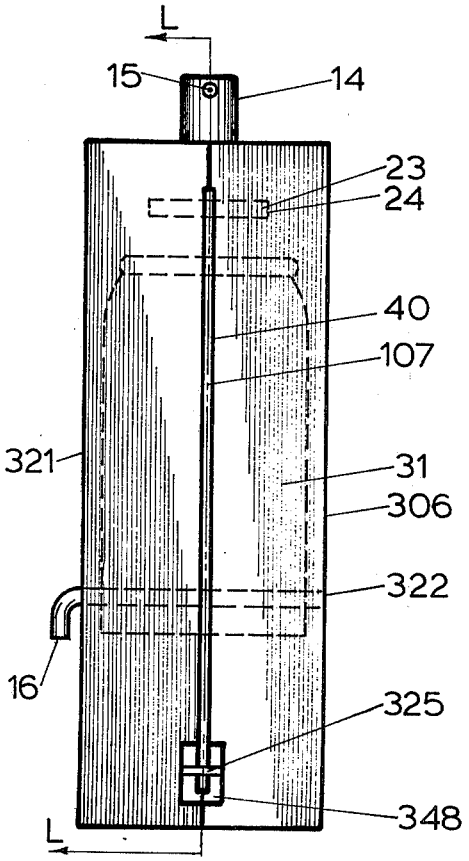
FIG. 23 is a front elevational view similar to FIG. 3 but showing a seventh embodiment of the anti-burglar device containing a pressurized container of the aerosol type with a projecting spout wherein the trigger element is held in the actuation position with a fusible link.
Figure 24:
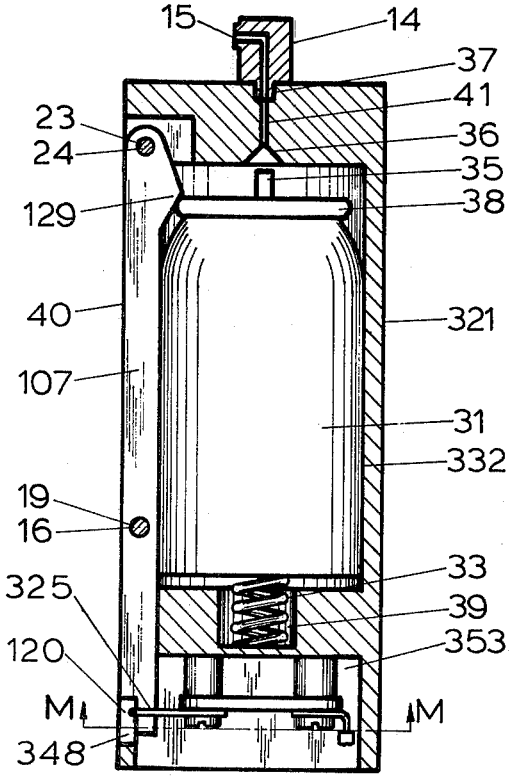
FIG. 24 is a vertical section taken along line L—L of FIG. 23 showing the pressurized container in its cocked position.
Figure 29:
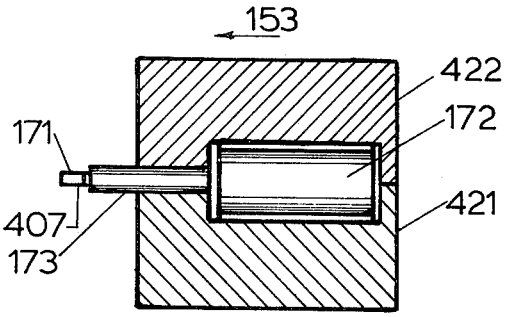
FIG. 29 is a horizontal section aken along line P—P of FIG. 27 similar to FIG. 28 but showing the electromechanical actuator in its release position.
Figure 28:
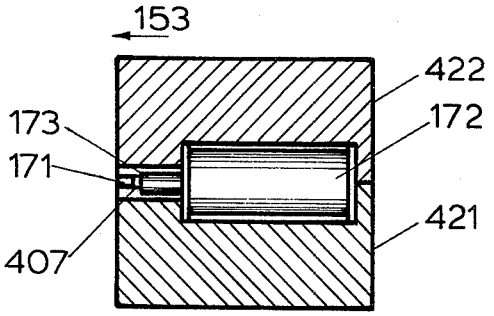
FIG. 28 is a horizontal section taken along line P—P of FIG. 27 showing the electromechanical actuator in its actuation position.
Figure 26:
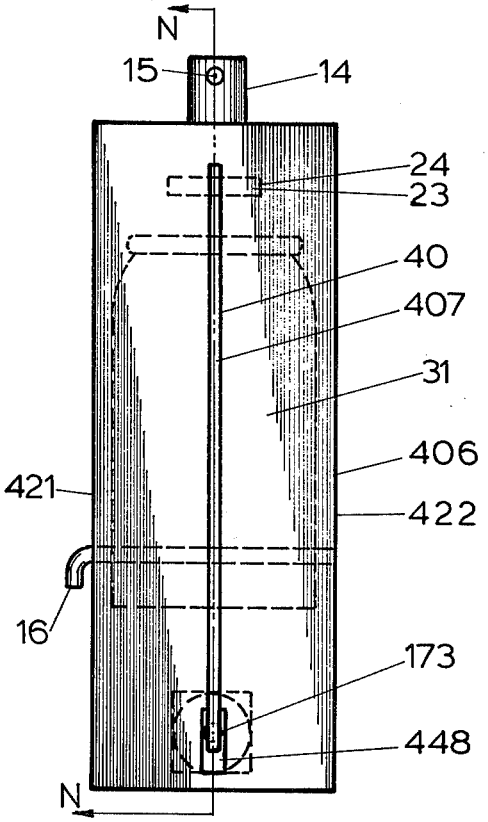
FIG. 26 is a front elevational view similar to FIG. 3 but showing an eighth embodiment of the anti-burglary device containing a pressurized container of the aerosol type with a projecting spout for positive release by electromechanical operation.
Figure 27:
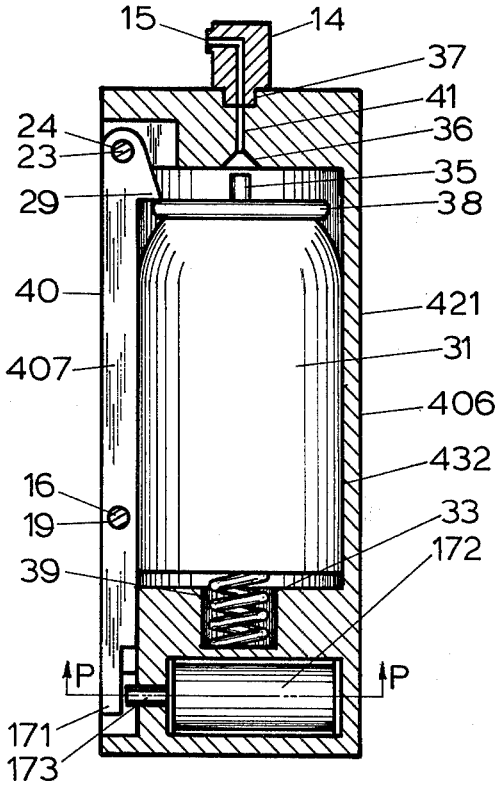
FIG. 27 is a vertical section taken along line N—N of FIG. 26 showing the pressurized container in a cocked position.

An eighth embodiment of the invention is illustrated in FIGS. 23–25. In this embodiment, the basic structure is as described in the sixth embodiment and like numbers are used to indicate like or corresponding parts. The chemical dispensing anti-burglary evice of this embodiment is generally noted device 306.

In this embodiment, the releasably retaining means acting on the self-camming trigger element 107, is a fusible link 325 which replaces the electromechanical actuator 141 of the sixth embodiment. The fusible link 325 will safely retain the self-camming trigger element 107 from rotation until an electric current is passed through the fusible link 325 in a manner previously described, in the sixth embodiment, causing fusible link 325 to melt and release the self-camming trigger element 107 which causes discharge. The fusible link 325 shown in FIGS. 23–25 may also replace the electromechanical actuator 141 in the sixth embodiment shown in FIGS. 16–21.

A ninth embodiment of the invention is illustrated in FIGS. 26–29. In this embodiment, the structure is as previously described in the first embodiment and like numbers are used to indicate like or corresponding parts.

In this embodiment, the trigger element 7 is replaced by a trigger element 407 wherein the notch 20 of trigger element 7 is replaced with an extension 171. In addition, the device 406 is equipped with an electromechanical actuator 172 of the solenoid push type wherein the solenoid plunger 173 is mounted to engage the extension 171 of trigger element 407.

The device 406 is installed in the manner described in the sixth embodiment and shown in FIGS. 14 and 15 wherein the device 106 is replaced by evice 406. As the window 3 is raised; the solenoid coil 172 is energized and the plunger 173 moves in the direction 153, pushing on extension 171 of trigger element 407. This releases the pressurized container 31, previously described and discharges the device.

The chemical dispensing anti-burglary device described herein in several embodiments was generally shown with a pressurized container 31 with a projecting dispensing spout 35 mounted to discharge into a funnel like entry section 36 of a fluid passageway 41 when the device is discharged. Alternately the device will also function with a pressurized container of the aerosol type with a recessed valve by providing a tubular member depending from the body member to cause discharge; in additon the devices can be used with a sealed pressurized container with a piercable seal; also the aerosol type container with a dispensing projecting cap wherein the projecting cap is depressed to cause discharge; but the invention is not limited to these type of containers.

Although I have herein shown and described the invention in what I have conceived to be the most practical and preferred embodiments, it is recognized that departure may be made therefrom within the scope of my invention, which is not to be limited to the details disclosed herein, but is to be accorded the full scope of the claims so as to embrace any and all equivalent structures and devices.

I claim:

1. A chemical dispensing anti-burglary device for use with a pressurized container, the device comprising: a body member; means for slidably supporting said pressurized container in said body member; a fluid passageway extending through said body member having an entry section at one end thereof and a means for directing fluid discharge from the other end thereof; means for causing the discharge of fluid from said pressurized container into said entry section of said fluid passageway; a spring biasing said pressurized container in said body member and arranged to cause fluid discharge from said pressurized container upon movement of said slidably supported pressurized container when said pressurized container is released; means for releasably retaining said pressurized container in a cocked position; said retaining means including a trigger element; said trigger element being mounted for movement between an actuation position and a release position; said trigger element having a shaped portion for engaging with said pressurized container whereby movement of said spring urged pressurized container will force said trigger element to move to said release position; a trigger holding means mounted for movement between a holding position and a release position; said trigger holding means in said holding position adapted to hold said trigger in said actuation position to retain said pressurized container in said cocked position; said trigger holding means in said release position allowing said spring urged pressurized container to be forced against said entry section, whereby the means for discharging fluid causes discharge.

2. The chemical dispensing anti-burglar device of claim 1 wherein said pressurized container includes a projecting dispensing spout, said dispensing spout discharging fluid upon depression thereof, said entry section being funnel shaped for receiving said projecting dispensing spout on said container.

3. The chemical dispensing anti-burglar device of claim 1 wherein said pressurized container includes a projecting dispensing cap actuated to permit fluid discharge therethrough upon depression thereof, means for restricting movement of said projecting dispensing cap by said body member, an aperture in said body member in communication with said cap, said slidably supported pressurized container arranged to actuate said dispensing cap thereby discharging fluid from said pressurized container through said cap and aperture when said pressurized container is released.

4. The chemical dispensing anti-burglar device of claim 1 in which the pressurized container comprises a pierceable section, means to provide a seal between said pierceable section and said entry section, and means for puncturing said pierceable section as the container is released, whereby fluid may be discharged.

5. The chemical dispensing anti-burglar device of claim 4 in which said means for puncturing comprises a projecting spout depending from said body member.

6. The chemical dispensing anti-burglar device of claim 1 wherein said trigger element is mounted for rotation between said actuation position and said release position.

7. The chemical dispensing anti-burglar device of claim 1 wherein said trigger element is mounted for sliding movement between said actuation position and said release position.

8. The anti-burglar chemical dispensing device of claim 1 and a means for electromechanically retaining and releasing said trigger element.

9. The anti-burglar chemical dispensing device of claim 8 wherein said electromechanical retaining-releasing means of said trigger element comprises a solenoid latch lever for holding said trigger element in said actuation position, said solenoid lever being resiliently held in engagement with said trigger element to retain said pressurized container in said cocked position and a magnetic cored coil for moving said solenoid lever out of engagement with said trigger element whereby said trigger element moves to said release position.

10. The chemical dispensing anti-burglar device of claim 1 wherein said trigger element in said actuation position is in cammed engagement with a surface of said pressurized container, said cammed engagement arranged to move said trigger element from said actuation position to said release position, means for holding said trigger element in engagement with said pressurized container, said holding means mounted for movement between holding position and a release position, said holding means in said holding position securing said trigger element in engagement with surface of said pressurized container, said holding means in said release position permitting trigger element to move to its release position.

11. The anti-burglar chemical dispensing device of claim 1, wherein there is means for retaining said trigger element in said actuation position, said retaining means comprising of a fusible link mounted in engagement with said trigger element to retain said trigger element in a cocked position, said fusible link to release asid trigger element when an electric current is passed through said fusible link.

12. The anti-burglar device of claim 1 wherein there is a means to safely retain said trigger element, said retaining means including a pin, said pin being mounted for an insertion position and a removable position, said pin in said insertion position being mounted through a hole in said body member in a manner to prevent movement of said trigger element, said removable position having pin removed permitting movement of said trigger element when actuated.

* * * * *